US007075041B2

(12) United States Patent
Kruempelmann et al.

(10) Patent No.: US 7,075,041 B2
(45) Date of Patent: Jul. 11, 2006

(54) METHOD FOR CONTROLLING A COOKING PROCESS IN A COOKING APPLIANCE AND COOKING APPLIANCE

(75) Inventors: Thomas Kruempelmann, Guetersloh (DE); Ulrich Sillmen, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 191 days.

(21) Appl. No.: 10/871,652

(22) Filed: Jun. 17, 2004

(65) Prior Publication Data

US 2005/0061799 A1 Mar. 24, 2005

(30) Foreign Application Priority Data

Jun. 18, 2003 (DE) ..... 103 27 861

(51) Int. Cl.
*H05B 1/02* (2006.01)

(52) U.S. Cl. ..... 219/497; 219/707; 219/492; 219/412; 99/325

(58) Field of Classification Search ..... 219/492, 219/497, 483–486, 412–414, 705, 707, 710; 99/325–333; 374/120, 121
See application file for complete search history.

(56) References Cited

U.S. PATENT DOCUMENTS 4,379,964 A * 4/1983 Kanazawa et al. ..... 219/492
4,488,026 A 12/1984 Tanabe ..... 219/10.55 B
4,496,817 A * 1/1985 Smith ..... 219/707
5,681,496 A 10/1997 Brownlow et al. ..... 219/707
2004/0104222 A1* 6/2004 Lee ..... 219/707

FOREIGN PATENT DOCUMENTS

| | | |
|---|---|---|
| DE | 3837072 | 5/1989 |
| DE | 4022964 | 11/1994 |
| EP | 0074764 | 3/1983 |
| EP | 0455169 | 11/1991 |

* cited by examiner

*Primary Examiner*—Mark Paschall
(74) *Attorney, Agent, or Firm*—Darby & Darby

(57) ABSTRACT

A method for controlling a cooking process in a cooking appliance having a sensor for measuring a gas concentration in the cooking chamber and an electric or electronic control system in communication with the sensor and including an evaluation circuit and a memory, includes ascertaining, as a function of a food to be cooked, a cooking end value stored in the memory. An output signal of the sensor is processed using the evaluation circuit so as to generate a cooking quotient. The cooking quotient at a point in time corresponds to a ratio of the first derivative of the output signal with respect to time to a first extreme value of the first derivative of the output signal with respect to time. A value of the cooking quotient is compared to the cooking end value using the evaluation circuit, and an appliance function is triggered.

13 Claims, 3 Drawing Sheets

METHOD FOR CONTROLLING A COOKING PROCESS IN A COOKING APPLIANCE AND COOKING APPLIANCE

Priority is claimed to German patent application DE 103 27 861.3, the subject matter of which is hereby incorporated by reference herein.

The present invention relates generally to cooking appliances, and in particular to a method for controlling a cooking process in a cooking appliance using a gas concentration sensor and to a cooking appliance for carrying out the method.

BACKGROUND

In a known method for controlling a cooking process in a cooking appliance including a cooking chamber, on or in which a heating source is provided for heating the cooking chamber, and further including a sensor for measuring a gas concentration in the cooking chamber as well as an electric or electronic control system which contains an evaluation circuit and a memory and is in signal communication with the sensor, initially, a cooking end value stored in the memory is ascertained by the evaluation circuit as a function of a food to be cooked, which is manually selected or automatically identified. As soon as the value of a variable depending on the output signal of the sensor falls below the cooking end value after the beginning of the cooking process, a cooking appliance function is automatically triggered. Thus, in the known method, the cooking appliance function, for example, switching off the heating source, is automatically triggered when the gas concentration of a gas escaping from the food to be cooked during the cooking process falls below a predetermined cooking end value.

The cooking end values for individual foods to be cooked were previously determined by tests. During the operation of conventional cooking appliances, ambient air is passed through the cooking chamber thereof. In the process, a fan located in the cooking appliance draws in ambient air through air inlet openings and exhausts vapors from the cooking chamber through a vapor duct. In this connection, the volume of ambient air drawn through the cooking chamber is always significantly larger than the volume of gases released by the food to be cooked during the cooking process. Therefore, the sensor detects an instantaneous gas concentration since the gases produced by the cooking process are continuously exhausted by the fan and thus removed from the cooking chamber. These gases do not concentrate in the cooking chamber.

The known method has the disadvantage that the cooking end value is dependent on the quantity of food to be cooked and on its distribution in the cooking chamber, for example, due to the use of different baking or roasting pans. Therefore, different cooking end values are obtained even for one and the same recipe. This leads to a multitude of cooking end values so that either complex control is required to detect the quantity and distribution of the food to be cooked, or the user must make further entries, which reduces the ease-of-use.

Moreover, a further method for controlling a cooking process in the form of a bread-baking process is known from German Patent Application D method only relates to bread-baking processes, it is not necessary here to identify the type of food to be cooked. In the known bread-baking method, the bread-baking process is controlled via the variation of the gas density with time in the cooking chamber, which is measured using a gas sensor. Here, for example, the heating element and the fan are automatically switched off, and the bread-baking process is thereby terminated, as soon as the gas density has fallen below a maximum value by a predetermined amount. Alternatively, it is proposed to use the change in gradient of the gas density, i.e., the change in the first derivative of the gas density with respect to time, for controlling the bread-baking process after the maximum value of the gas density has been detected by the gas sensor.

Another method is known from European Patent Application EP 0 455 169 A2. In this method, electrical output voltages present at a gas sensor are processed in an evaluation of a control system when two predetermined temperatures are reached. In the process, the gas sensor transmits to the evaluation circuit a first output voltage before the beginning of the cooking process, i.e., at the initial temperature for the cooking process, and a second output voltage when a predetermined temperature is reached during the cooking process; a cooking quotient being calculated from the two output voltages of the gas sensor. This cooking quotient is compared with predetermined reference values stored in a memory. The type of food to be cooked is inferred depending on whether the cooking quotient is greater or less than a first or a second reference value. For example, if the cooking quotient falls below the second reference value, the cooking process is continued for a predetermined time at a further predetermined cooking temperature, and automatically terminated at a later point in time.

SUMMARY OF THE INVENTION

It is therefore an object of the present invention to provide a method for controlling a cooking process in which control is implemented in a simple manner, even for different types of food to be cooked and for different quantities and distributions of a food to be cooked in the cooking chamber, and in which, at the same time, a remaining cooking time can be determined with high accuracy and reproducibility, independently of the food to be cooked.

The present invention provides a method for controlling a cooking process in a cooking appliance having a cooking chamber, a heating source for heating the cooking chamber, a sensor for measuring a gas concentration in the cooking chamber, and an electric or electronic control system in signal communication with the sensor, the control system including an evaluation circuit and a memory, the method comprising. The method includes:

ascertaining, as a function of a food to be cooked and using the evaluation circuit, a cooking end value stored in the memory, the cooking end value being manually selected or automatically identified;

processing an output signal of the sensor using the evaluation circuit so as to generate a cooking quotient, the cooking quotient at a point in time corresponding to a ratio of the first derivative of the output signal with respect to time to a first extreme value of the first derivative of the output signal with respect to time, the first extreme value being detected at an earlier point in time after a beginning of the cooking process;

comparing a value of the cooking quotient to the cooking end value using the evaluation circuit; and triggering an appliance function upon a falling of the value of the cooking quotient below the cooking end value after the beginning of the cooking process.

Advantageously, the method according to the present invention is implemented in a simple manner, even for different types of food to be cooked and for different quantities and distributions of a food to be cooked in the cooking chamber, and that, at the same time, a remaining cooking time can be determined with high accuracy and reproducibility, independently of the food to be cooked.

Moreover, the method according to the present invention can also be used for cooking processes in which different cooking chamber temperatures are used for a food to be cooked because the cooking end value does not depend on the quantity of food to be cooked, its distribution in the cooking chamber, or the cooking chamber temperature for the cooking process since these parameters, which vary from cooking process to cooking process, are compensated by using a cooking quotient. This cooking quotient corresponds to the ratio of the first derivative of the output signal with respect to time to a first extreme value of the first derivative of the output signal with respect to time, the extreme value being detected at an earlier point in time after the beginning of the cooking process. The use of f' in place of f has the advantage that when the extreme value of f' has been passed, the remaining cooking time can be extrapolated in the evaluation circuit with high accuracy and reproducibility as a function of the sensor output signal and displayed on the display element since the time at which the value of f' becomes extreme is long before the end of cooking time $t_{end}$. Instead of a visual indication, it is also conceivable, for example, to trigger an audible signal.

In an embodiment of the present invention, the sensor measures the concentration of an atmospheric gas, in particular, oxygen, nitrogen, or carbon dioxide. In this manner, the accuracy and reproducibility of the values measured using the method according to the present invention and thus of the inventive method are further improved since the volume of an atmospheric gas is large enough during the entire cooking process to ensure a reliable measurement. Here, particular mention is to be made of oxygen, nitrogen and carbon dioxide due to their high concentration in the atmosphere.

The type and scope of the appliance function can, in principle, be selected within wide suitable limits. Expediently, the appliance function triggered is the automatic switching off of the heating source for heating the cooking chamber and/or a cooking end signal.

In an embodiment, after the gas concentration or the first derivative of the gas concentration with respect to time reaches an extreme value for the first time after the beginning of the cooking process, the remaining cooking time is extrapolated as a function of the sensor output signals and displayed on a display element of the cooking appliance. This further enhances user convenience without additional components, and thus in a cost-effective manner.

The extreme value can, in principle, be a minimum or a maximum value. Conveniently, the extreme value is a maximum value.

In an embodiment, the sensor output signal is processed in the evaluation circuit only after a predetermined time delay has elapsed after the beginning of the cooking process. This ensures that disturbances of the output signal during an initial period after the beginning of the cooking process cannot affect the processing of the output signal in an unwanted manner.

Another object of the present invention is to provide a cooking appliance for carrying out the method according to the present invention.

The present invention also provides a cooking appliance including a cooking chamber; a heating source disposed on or in the cooking chamber and configured to heat the cooking chamber; a sensor configured to measure a gas concentration in the cooking chamber; and an electric or electronic control system including an evaluation circuit and a memory, the memory being configured to store a cooking end value, the control system configured for signal communication with the sensor. The evaluation circuit is configured to:

ascertain the cooking end value as a function of a food to be cooked, the cooking end value being manually selected or automatically identified;

process an output signal of the sensor so as to generate a cooking quotient, the cooking quotient at a point in time corresponding to a ratio of the first derivative of the output signal with respect to time to a first extreme value of the first derivative of the output signal with respect to time, the first extreme value being detected at an earlier point in time after a beginning of a cooking process; and compare a value of the cooking quotient to the cooking end value so as to trigger an appliance function upon a falling of the value of the cooking quotient below the cooking end value after the beginning of the cooking process.

BRIEF DESCRIPTION OF THE DRAWINGS

An exemplary embodiment of the present invention is shown in the drawings in a schematic way and will be described in more detail below.

DETAILED DESCRIPTION

Figure 5:
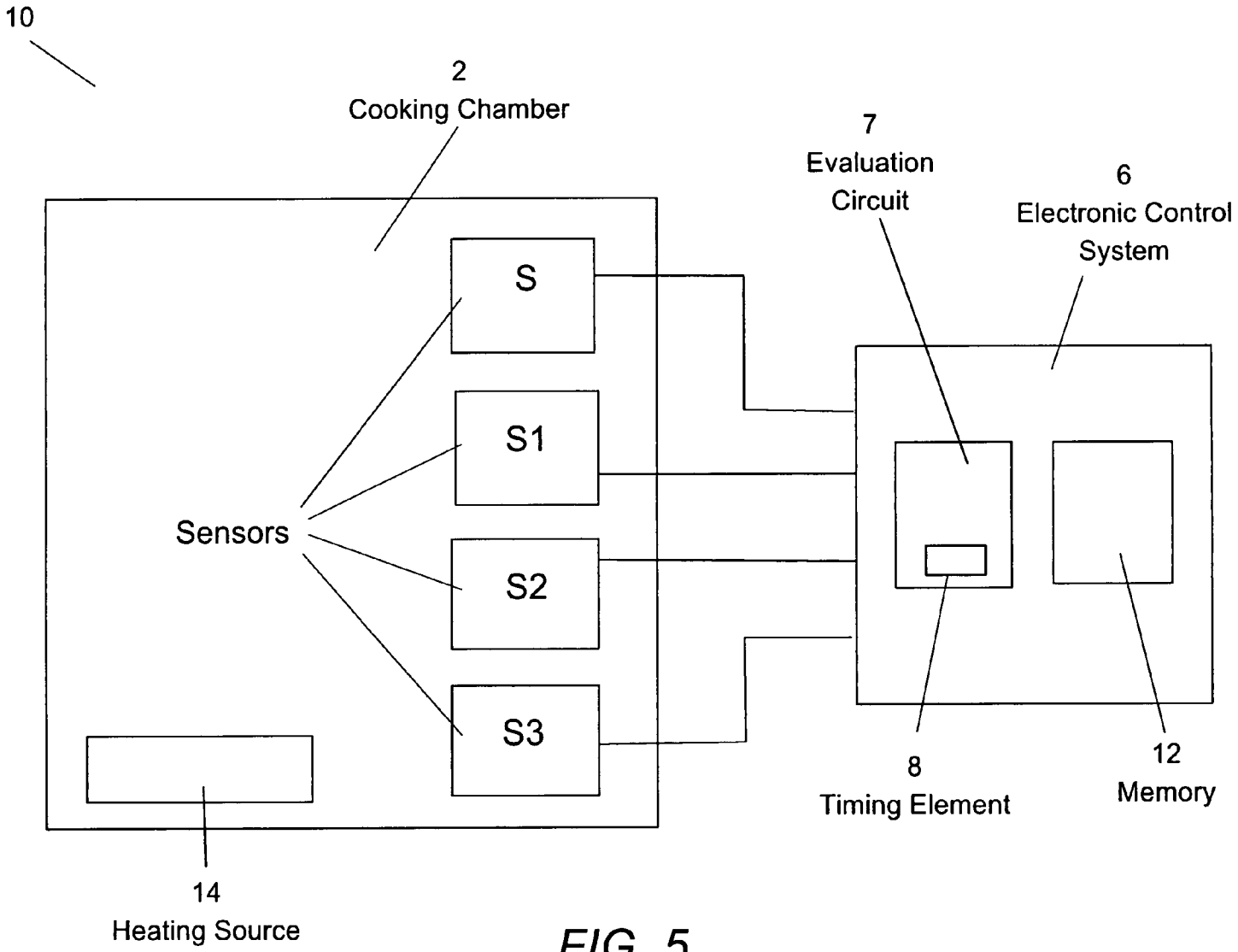
FIG. 5 shows a cooking appliance according to the present invention.

A cooking appliance according to the present invention is designed as an electric range. As shown in FIG. 5, the cooking appliance 10 includes a cooking chamber 2, which can be closed by a door, a sensor S in the form of an oxygen sensor for measuring a gas concentration in the cooking chamber as well as an electronic control system 6, which contains an evaluation circuit 7 with a timing element 8 and a memory 12 and is in signal communication with the oxygen sensor and a heating source 14 in the form of a resistance heater for heating the cooking chamber. In the present exemplary embodiment, an amperometrically operated solid electrolyte sensor based on zirconium oxide was used.

During operation of the cooking appliance according to the present invention, ambient air is passed through the cooking chamber thereof as usual. In the process, a fan located in the cooking appliance draws in ambient air through air inlet openings and exhausts vapors from the cooking chamber through a vapor duct. In this connection, the volume of ambient air drawn through the cooking chamber is always significantly larger than the volume of gases released by the food to be cooked during the cooking process. Therefore, the sensor detects an instantaneous gas concentration since the gases produced by the cooking process are continuously exhausted by the fan and thus removed from the cooking chamber. These gases do not concentrate in the cooking chamber.

The cooking appliance according to the present invention may optionally be equipped with or without catalyst, the catalyst being mounted in the vapor duct in a manner known to one skilled in the art. If the cooking appliance contains a catalyst, it is generally advantageous to place the sensor downstream of the catalyst in the direction of flow since the sensor output signal transmitted to the evaluation circuit is thereby amplified. This is the case because the oxidizable gas molecules escaping from the food to be cooked are oxidized by the action of the catalyst, and the number of gas molecules that displace the atmospheric gases is thereby increased downstream of the catalyst. In the process, oxygen is consumed. If, as in this exemplary embodiment, an oxygen sensor is used, then the oxygen concentration downstream of the catalyst in the direction of flow is reduced to a greater extent than if the oxygen sensor is mounted upstream of the catalyst in the direction of flow. When sensors are used which detect gases that are formed during the cooking process and released by the food to be cooked, the output signal of such sensors is also amplified due to the increase in the number of gas molecules. Therefore, first of all, the evaluation of the output signal, and thus the control of the cooking process, is further improved. Secondly, it is possible to use a sensor that is less sensitive and therefore less expensive.

Installation of the sensor downstream of the catalyst in the direction of flow is, in principle, possible for all suitable sensors and useful for the reasons mentioned above. However, this is not true when a carbon dioxide sensor is used, i.e., when the concentration of carbon dioxide is to be measured and used for the method according to the present invention because the variation of the carbon dioxide concentration with time differs from that of the other atmospheric gases and of the other gases released by the food to be cooked during the cooking process. While the concentration of these gases increases or decreases from an initial value or zero to an extreme value, respectively, and the time at which this extreme value is reached corresponds to the end of cooking time, the carbon dioxide concentration exceeds a maximum value during the cooking process, then it decreases again reaching the value zero at the end of cooking time. Thus, the carbon dioxide concentration profile corresponds qualitatively to the profiles of the first derivatives of the other gas concentrations with respect to time. The catalyst produces additional carbon dioxide so that, unlike in the case of the other gases, installation of the carbon dioxide sensor downstream of the catalyst in the direction of flow results in that the output signal for controlling the cooking process is not amplified but corrupted in an unwanted manner. Thus, because of decomposition reactions at the catalyst, a carbon dioxide concentration would still be detected, even though the actual end of cooking time would already have been reached.

Also provided in this exemplary embodiment are control and display elements, which are also in signal communication with the control system. The control and display elements are used, for example, to manually set the appliance function to be triggered, for example, "fast cooling" by automatically switching on the fan, or automatically increasing the fan speed, or "keeping warm" by automatically reducing the heating power of the heating source. It is also conceivable that this is done automatically by selecting a recipe stored in a memory of the cooking appliance.

Figure 1:
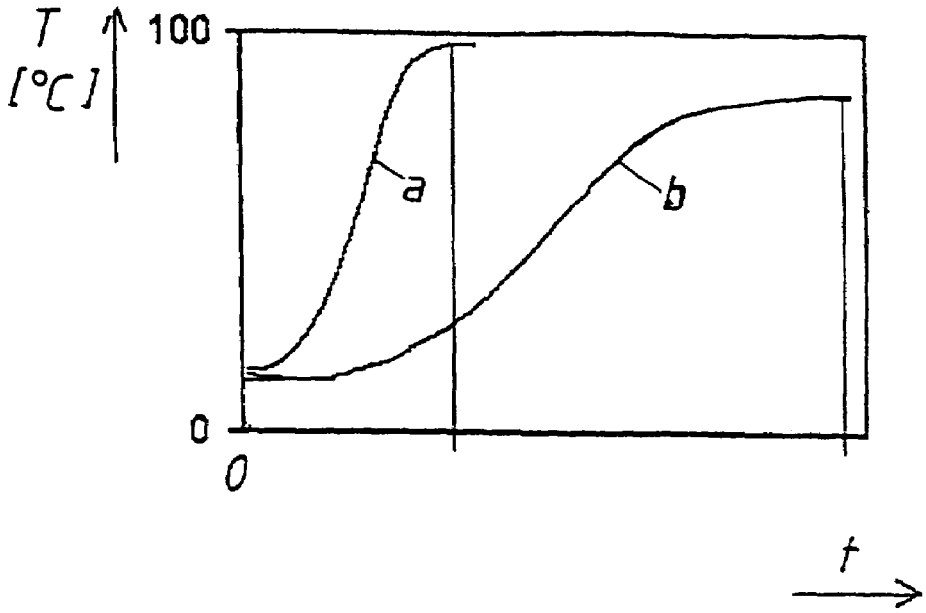
FIG. 1 shows a temperature-time diagram for the method according to the present invention.

In FIG. 1, a temperature-time diagram is shown for the method according to the present invention, including two exemplary temperature profiles. Shown in each case is the temperature profile of the lowest temperature in the dough, i.e., the core temperature. Curve a shows the temperature profile of dough spread on a baking tray, and curve b shows the temperature profile of a piece of beef placed on a baking tray.

The dough on the baking tray and the piece of beef are put into the cooking chamber and the door is closed. Both samples are prepared fresh so that, in each case, the food to be cooked is at room temperature, i.e., at about 20° C. When the cooking process is started via the control element, i.e., the heating source is switched on, the temperature in the dough on the baking tray increases faster to a maximum than the temperature in the piece of beef (see curves a, b). While the maximum temperature in all baking processes is about 98° C., the maximum temperature at the core of meat varies. For example, the maximum temperature is about 85° C. for beef and about 75° C. for pork. Once the respective maximum temperature is reached, the cooking process is completed and the heating source may be switched off manually by the user or automatically by the control system.

In tests, it was found that the release of gases escaping from the food to be cooked and the release of moisture are maximum at the maximum temperature, i.e., when the cooking process is completed. After that, the gas release and the moisture release from the food to be cooked decrease again because the chemical reactions in the food to be cooked during the cooking process are completed and/or because the food to be cooked becomes drier as time progresses and therefore less steam escapes from the food to be cooked. The different conditions for carbon dioxide have already been explained.

A good cooking result can be achieved, for example, if the heating source is switched off as soon as the value of the cooking quotient falls below a cooking end value after the beginning of the cooking process and the associated heating of the food to be cooked. This cooking quotient corresponds to the ratio of the first derivative of the output signal with respect to time to a first extreme value of the first derivative of the output signal with respect to time, the extreme value being detected at an earlier point in time after the beginning of the cooking process.

When using an oxygen sensor, the extreme value would be a minimum because the oxygen present in the cooking chamber at the beginning of the cooking process is, first of all, displaced during the cooking process by the gases and moisture escaping from the food to be cooked and, secondly, is consumed by chemical reactions during the cooking process. Unlike this, the extreme value would be a maximum when measuring gases escaping from the food to be cooked. The same applies to the moisture, i.e. steam, escaping from the food to be cooked.

For the processing in the evaluation circuit, it is expedient to use only positive values. This is achievable by using function f' (see FIG. 2) in place of an original function g'. A function g here represents the concentration of oxygen in the cooking chamber, while function f represents 1 minus the concentration of oxygen in the cooking chamber. Functions g' and f represent the first derivative with respect to time of functions g and f, respectively.

Figure 2:
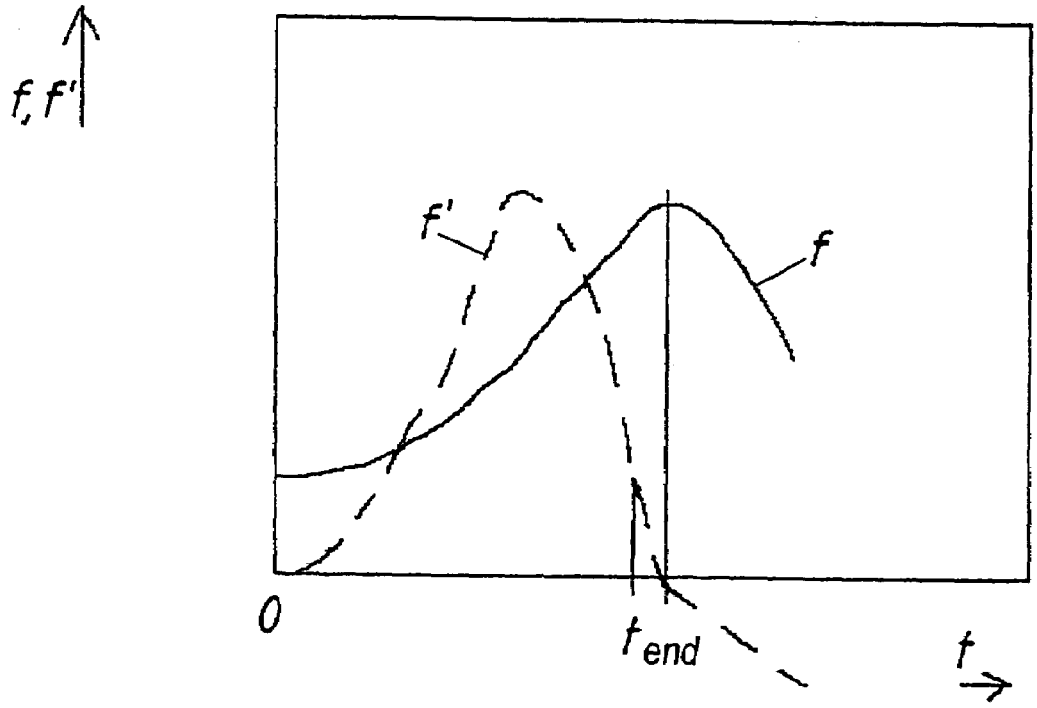
FIG. 2 shows a time history of function a function f representative of 1 minus the concentration of oxygen in a cooking chamber and a time history of a function f, the first derivative of function f with respect to time.

FIG. 2 shows examples of a time history of function f, and of the first derivative f of function f with respect to time.

At the beginning of the cooking process, i.e., at t=0, function f has an initial value, which is only dependent on the oxygen concentration in the ambient environment. As already described above, the oxygen concentration decreases during the cooking process so that the value of f increases. In the process, function f passes through a point of inflection, i.e., through the point of maximum gradient of f, and continues to increase to a maximum value.

For the purpose of controlling the cooking process, the first derivative f with respect to time is used for all gases that are suitable for carrying out the method according to the present invention (see also FIG. 2).

At the beginning of the cooking process, f=0. During the cooking process, the value of f increases and reaches a maximum value at the time when f passes through the point of inflection. As the cooking process proceeds, the value of f decreases again and reaches the value zero at the time when f reaches the maximum value.

Figure 3:
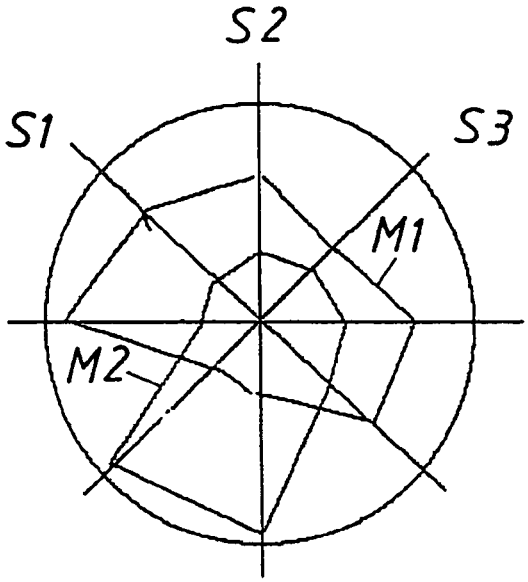
FIG. 3 is a diagram of a first exemplary embodiment of an automatic identification of food to be cooked for the method according to the present invention.
Figure 4:
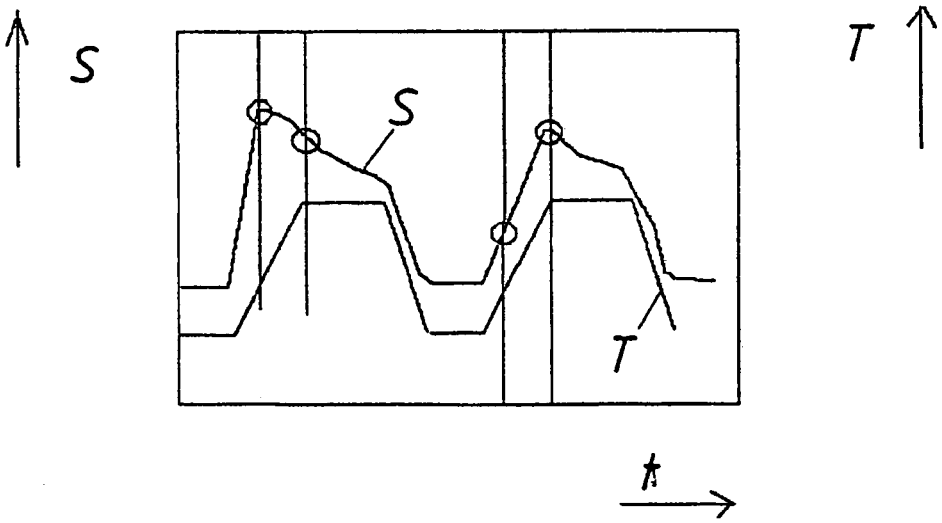
FIG. 4 shows a time history for a second exemplary embodiment of an automatic identification of food to be cooked for the method according to the present invention.

Once the value of the cooking quotient falls below the cooking end value, the cooking process is completed, i.e., the end of cooking time $t_{end}$ is reached. Each food to be cooked is assigned a cooking end value, which is determined, for example, by tests, and stored in the memory of the electronic control system. Here, "food to be cooked" is understood to also include recipes which differ from each other, i.e., for example, the final cooked state of beef. Since the cooking quotient corresponds to the ratio of the first derivative of the output signal with respect to time to a first extreme value, here a maximum value, of the first derivative of the output signal with respect to time, the extreme value being detected at an earlier point in time after the beginning of the cooking process, the cooking quotient can be determined only after this extreme value has been passed. Until that point, the cooking chamber is heated either according to a cooking program entered by the user, or according to a heating program predefined for all cooking programs, such as a gentle heating program that is suitable for all foods to be cooked. If the cooking appliance is equipped with a function for automatically identifying food to be cooked, this function is carried out during this first heating phase; i.e., until the extreme value of the first derivative of the output signal with respect to time is reached. The automatic identification of food to be cooked is explained in more detail further below with reference to FIGS. 3 and 4.

In another embodiment, the sensor output signal is processed in the evaluation circuit only after a predetermined time delay has elapsed after the beginning of the cooking process. This ensures that disturbances of the output signal during an initial period after the beginning of the cooking process cannot affect the processing of the output signal in an unwanted manner. The output signal may be disturbed, for example, by fast heating; i.e., heating at maximum heating power, or by switching on a convection fan. This results in local extreme values, i.e., local minimum and maximum values. In this connection, the duration of the delay time can be determined and defined, for example, by tests.

Thus, when the condition $\{f/f'_{extreme}\}<G$ exists for the first time, the cooking process is completed, i.e., the end of cooking time $t_{end}$ is reached, and the appliance function is triggered.

In this connection, cooking end value G can be positive, equal to zero, or negative. The further profile of f' is irrelevant to the control of the cooking process.

The use of f' in place of f' has the advantage that when the extreme value of f' has been passed, the remaining cooking time can be extrapolated in the evaluation circuit with high accuracy and reproducibility as a function of the sensor output signal and displayed on the display element since the time at which the value of f' becomes extreme is long before the end of cooking time $t_{end}$. Instead of a visual indication, it is also conceivable, for example, to trigger an audible signal.

In connection with the above explanations, it should be noted that the terms "extreme value" and "maximum and minimum values" are not to be understood in a strictly mathematical sense. In the context of the present invention, these terms are understood to also include a plateau, which means that the gas concentration remains constant at the highest or lowest value for a period of time.

In the method according to the present invention, the end of cooking time $t_{end}$ is the point in time when the food to be cooked is cooked to completion at its core. For example, the superficial brown color of the food to be cooked is dependent on the selected cooking chamber temperature. If a high cooking chamber temperature is input by the user via the control and display elements or automatically set for the cooking process by selecting a recipe, then the superficial brown color of the food to be cooked at the end of cooking time $t_{end}$ will be more intense than in the case of a lower cooking chamber temperature.

The processing of the sensor output signal in the electronic control system will be explained in more detail below:

The heating source of the cooking appliance is switched off and a cake pan containing dough is put into the cooking chamber. The door is closed. The output signal of the oxygen sensor, for example, an electrical voltage depending on the oxygen concentration in the ambient environment, is transmitted to the evaluation circuit of the electronic control system via an electric line. The output signal is associated with time information via the timing element of the evaluation circuit. The value pair consisting of the output signal and the time information is subsequently stored in the memory for further use in the evaluation circuit. Since the output signal of the oxygen sensor has not yet changed as a function of time, f'=0. After the heating source of the cooking appliance has been switched on via the control element, i.e., after the electronic control system has electrically conductively connected the heating source to an electrical mains voltage, the cooking chamber heats up and thus also the dough contained therein.

During the cooking process, the concentration of gases escaping from the food to be cooked increases so that the oxygen concentration, and thus the electrical output signal, are reduced. The analogous is true for the steam escaping from the food to be cooked. Due to this, the value of f' generated in the evaluation circuit increases to a maximum value. This is automatically detected by the electronic control system through continuous comparison of the stored value pairs with the value pair that is currently created in the evaluation circuit. After that, the value of f' decreases again. The output signals transmitted by the oxygen sensor to the evaluation circuit in the process are used to extrapolate the remaining cooking time using the evaluation circuit and to display it on the display element. In the process, the further profile of f' is continuously extrapolated using a predetermined approximation function stored in the memory, for example, the line equation, as well as the current output signal, and the time until the condition $\{f'/f'_{extreme}\}<G$ is reached, i.e., the remaining cooking time, is determined. If the condition $\{f'/f'_{extreme}\}<G$ is actually met, then the heating source is switched off by the electronic control system and a cooking end signal is displayed on the display element.

Unlike the present exemplary embodiment, it is also possible to use concentrations of the gases produced by the cooking process or of other atmospheric gases, in particular, nitrogen or carbon dioxide. In this connection, steam is a special case because steam is present in the atmosphere and, moreover, is produced or released during all baking processes. Alternatively or in addition to switching off the heating source, it is also conceivable to trigger other appliance functions. For example, the reaching of the end of cooking time may be displayed on the display element of the cooking appliance and/or the heating power may be reduced to such an extent that a keep-warm temperature is present in the cooking chamber. Furthermore, it is conceivable to trigger a fast cooling of the cooking chamber or of the food to be cooked.

As explained earlier, it is possible for the user to manually select the food to be cooked via the control elements. In a cooking appliance, in which ease-of-use is further improved, it is also conceivable that the food to be cooked in the particular cooking process is automatically identified by a function for identifying food to be cooked. In this connection, in an embodiment the cooking appliance has at least two further sensors; the individual further sensors differing with respect to the detectable types of gas in at least one gas type. Thus, the cooking appliance according to the present invention has at least three sensors S1, S2 and S3 for measuring gas concentrations (see FIG. 3). The more sensors are used for identifying food to be cooked, the greater the accuracy with which the particular food to be cooked can be determined. Analogously to the above embodiments, the individual output signals of sensors S1, S2 and S3 are transmitted to the electronic control system for processing. When viewed in combination, the output signals produce a characteristic pattern M1 and M2 for each food to be cooked. These patterns M1, M2 are associated with individual foods to be cooked, for example, by tests, at an earlier point in time and stored in the memory of the electronic control system. The particular food to be cooked in the current cooking process can be determined by comparing the output signals that are transmitted to the evaluation circuit during heating to the output signals that have been stored at an earlier point in time.

Alternatively, the automatic identification of food to be cooked may be carried out using only one sensor S1. In this case, a predetermined temperature-time profile is repeated several times during the heating phase. In the process, the gas concentration is measured by sensor S1 at different points in time, and a value triple of output signal S, time information t, and temperature T is created in the evaluation circuit and stored in the memory (see FIG. 4). The totality of value triples stored as the temperature-time profile progresses forms a pattern analogous to the above embodiment. The further processing corresponds to the above explanations.

In an embodiment, the sensor is, at the same time, designed as a further sensor S1 for identifying food to be cooked. Thus, in the latter embodiment of the automatic identification of food to be cooked, a single sensor would be sufficient, first of all, to automatically identify the food to be cooked and, secondly, to allow a cooking end value stored in the memory to be ascertained as a function of the automatically identified food to be cooked.

The invention is not limited to the aforementioned embodiments. For example, the method according to the present invention and the cooking appliance for carrying out the inventive method for controlling the cooking process are not limited to a choice of recipes or foods to be cooked, operating modes or oven temperatures.

What is claimed is:

1. A method for controlling a cooking process in a cooking appliance having a cooking chamber, a heating source for heating the cooking chamber, a sensor for measuring a gas concentration in the cooking chamber, and an electric or electronic control system in signal communication with the sensor, the control system including an evaluation circuit and a memory, the method comprising:

ascertaining, as a function of a food to be cooked and using the evaluation circuit, a cooking end value stored in the memory, the cooking end value being manually selected or automatically identified;

processing an output signal of the sensor using the evaluation circuit so as to generate a cooking quotient, the cooking quotient at a point in time corresponding to a ratio of the first derivative of the output signal with respect to time to a first extreme value of the first derivative of the output signal with respect to time, the first extreme value being detected at an earlier point in time after a beginning of the cooking process;

comparing a value of the cooking quotient to the cooking end value using the evaluation circuit; and triggering an appliance function upon a falling of the value of the cooking quotient below the cooking end value after the beginning of the cooking process.

2. The method as recited in claim 1 wherein the heating source is disposed on or in the cooking chamber.

3. The method as recited in claim 1 wherein the sensor is configured to measure a concentration of an atmospheric gas.

4. The method as recited in claim 3 wherein the atmospheric gas is at least one of oxygen, nitrogen, and carbon dioxide.

5. The method as recited in claim 1 wherein the appliance function includes at least one of an automatic switching off of the heating source and a cooking end signal.

6. The method as recited in claim 1 further comprising, after the gas concentration or the first derivative of the gas concentration with respect to time reaches an extreme value for a first time after a beginning of the cooking process, extrapolating a remaining cooking time as a function of the output signal of the sensor and displaying the extrapolated remaining cooking time on a display element of the cooking appliance.

7. The method as recited in claim 1 wherein the extreme value is a maximum value.

8. The method as recited in claim 1 wherein the processing the output signal of the sensor is performed only after a predetermined time delay has elapsed after a beginning of the cooking process.

9. A cooking appliance comprising:

a cooking chamber;

a heating source disposed on or in the cooking chamber and configured to heat the cooking chamber;

a sensor configured to measure a gas concentration in the cooking chamber; and an electric or electronic control system including an evaluation circuit and a memory, the memory being configured to store a cooking end value, the control system configured for signal communication with the sensor, the evaluation circuit being configured to:

ascertain the cooking end value as a function of a food to be cooked, the cooking end value being manually selected or automatically identified;

process an output signal of the sensor so as to generate a cooking quotient, the cooking quotient at a point in time corresponding to a ratio of the first derivative of the output signal with respect to time to a first extreme value of the first derivative of the output signal with respect to time, the first extreme value being detected at an earlier point in time after a beginning of a cooking process; and compare a value of the cooking quotient to the cooking end value so as to trigger an appliance function upon a falling of the value of the cooking quotient below the cooking end value after the beginning of the cooking process.

10. The cooking appliance as recited in claim 9 further comprising at least two further sensors each configured to detect a different respective type of gas.

11. The cooking appliance as recited in claim 10 wherein the at least two further sensors are useable to identify the food to be cooked.

12. The cooking appliance as recited in claim 9 wherein the electric or electronic control system is configured to identify the food to be cooked using the output signal of the sensor.

13. The cooking appliance as recited in claim 12 wherein the sensor is configured to measure a concentration of a plurality of gases.

* * * * *